US010966898B2

(12) United States Patent
Nichols et al.

(10) Patent No.: US 10,966,898 B2
(45) Date of Patent: Apr. 6, 2021

(54) FIDGET SLEEVE

(71) Applicants: William James Nichols, Flora, IN (US); David Daniel Nichols, Flora, IN (US); Kevin Daniel May, Kokomo, IN (US); Joseph Nathanial Hackett, Kokomo, IN (US); Julia Ann May, Kokomo, IN (US); Martin Pike, Kokomo, IN (US); Rosemary Louise Saile Pike, Kokomo, IN (US)

(72) Inventors: William James Nichols, Flora, IN (US); David Daniel Nichols, Flora, IN (US); Kevin Daniel May, Kokomo, IN (US); Joseph Nathanial Hackett, Kokomo, IN (US); Julia Ann May, Kokomo, IN (US); Martin Pike, Kokomo, IN (US); Rosemary Louise Saile Pike, Kokomo, IN (US)

( * ) Notice: Subject to any disclaimer, the term of this patent is extended or adjusted under 35 U.S.C. 154(b) by 71 days.

(21) Appl. No.: 14/614,537

(22) Filed: Feb. 5, 2015

(65) Prior Publication Data

US 2016/0232804 A1 Aug. 11, 2016

(51) Int. Cl.

| | |
|---|---|
| ***A61H 7/00*** | (2006.01) |
| ***A63B 23/16*** | (2006.01) |
| ***A63B 21/072*** | (2006.01) |
| ***B43K 29/00*** | (2006.01) |
| ***A63B 71/06*** | (2006.01) |
| ***A63B 21/00*** | (2006.01) |

(52) U.S. Cl.

CPC ..... *A61H 7/003* (2013.01); *A61H 7/001* (2013.01); *A63B 21/072* (2013.01); *A63B 23/16* (2013.01); *B43K 29/00* (2013.01); *A61H 2201/0153* (2013.01); *A61H 2201/1253* (2013.01); *A61H 2201/1692* (2013.01); *A61H 2201/1695* (2013.01); *A61H 2205/065* (2013.01); *A61H 2205/067* (2013.01); *A63B 21/0004* (2013.01); *A63B 21/00061* (2013.01); *A63B 2071/0655* (2013.01); *A63B 2225/08* (2013.01)

(58) Field of Classification Search

CPC ..... A63H 33/042; A63H 33/04; A63H 33/00; B43K 23/008; B43K 29/00; B43K 25/024; A63F 9/088; A63B 23/16

USPC ..... 446/71, 239, 241, 486, 491; 401/6, 52, 401/195

See application file for complete search history.

(56) References Cited

U.S. PATENT DOCUMENTS 2,586,674 A * 2/1952 Lonne ..... A61F 6/04 128/844
3,184,883 A * 5/1965 McCook ..... A63H 33/006 2/311
3,442,267 A * 5/1969 Krygier ..... A61F 5/50 128/879
3,615,596 A * 10/1971 Petti ..... A23G 3/563 426/104
3,832,799 A * 9/1974 Vennola ..... A63H 33/006 446/227

(Continued)

*Primary Examiner* — Joseph B Baldori

(74) *Attorney, Agent, or Firm* — Saile Ackerman LLC; Stephen B. Ackerman; Rosemary L. S. Pike

(57) ABSTRACT

An elongate hollow tube having two or more fidgets molded onto or attached to an outside surface of said tube is described. The tube can be slipped over a smooth elongated base object, such as a pencil or similar object, to provide manipulatives for students.

20 Claims, 1 Drawing Sheet

(56) References Cited

U.S. PATENT DOCUMENTS 3,911,618 A * 10/1975 Gerst ..... A63H 3/14 446/329
4,281,472 A * 8/1981 Hill ..... A63H 33/40 446/26
4,440,399 A * 4/1984 Smith ..... A63B 63/06 273/348.4
4,728,212 A * 3/1988 Spector ..... B65D 83/00 40/334
4,852,586 A * 8/1989 Haines ..... A61F 6/04 128/842
4,881,746 A * 11/1989 Andreesen ..... A63H 33/006 224/411
5,083,881 A * 1/1992 Yoshinaga ..... B43K 29/00 401/112
D328,310 S * 7/1992 Yoshinaga ..... D11/117
5,236,446 A * 8/1993 Dumon ..... A61F 2/04 128/830
5,310,345 A * 5/1994 Gershon ..... G09B 11/02 15/443
5,334,118 A * 8/1994 Dantolan ..... A63B 15/005 482/93
5,433,642 A * 7/1995 Chia ..... B43K 8/22 401/195
5,487,201 A * 1/1996 Hansen ..... A46B 5/04 132/309
5,505,553 A * 4/1996 Saviano ..... B43K 23/004 401/100
5,584,195 A * 12/1996 Liu ..... A44C 5/0007 401/131
5,609,509 A * 3/1997 Stamos ..... A63H 1/06 362/34
D398,033 S * 9/1998 Toy ..... D21/465
5,830,035 A * 11/1998 Budreck ..... A63H 3/14 446/26
D414,553 S * 9/1999 Gonzalez ..... D24/105
D423,575 S * 4/2000 Lowe ..... D19/123
6,086,445 A * 7/2000 Zawitz ..... B43K 5/005 242/588.1
D434,138 S * 11/2000 DeVries ..... D24/105
6,158,914 A * 12/2000 Junkins ..... B43K 5/005 401/195
6,200,046 B1 * 3/2001 Rylander ..... B43K 23/08 401/195
D446,811 S * 8/2001 Beard ..... D19/152
6,332,727 B1 * 12/2001 Hsu ..... B43K 29/00 401/195
6,394,874 B1 * 5/2002 Kubo ..... A63H 3/14 446/321
6,584,637 B1 * 7/2003 Witter ..... A46B 5/04 15/160
6,612,766 B2 * 9/2003 Collins ..... B43K 7/005 401/195
6,752,555 B2 * 6/2004 Geddes ..... B43K 23/008 16/430
6,793,426 B2 * 9/2004 Willat ..... B43K 23/004 401/6
D507,684 S * 7/2005 Jager ..... D30/160
7,014,379 B2 * 3/2006 Cheng ..... B43K 23/004 16/430
7,029,361 B2 * 4/2006 Seibert ..... A63H 3/14 446/26
7,056,051 B2 * 6/2006 Fiffie ..... B43K 29/00 40/905
D525,357 S * 7/2006 Barrett ..... D24/105
7,131,785 B1 * 11/2006 Mansouri ..... A23G 3/50 401/195
7,182,993 B1 * 2/2007 Hamilton ..... A47B 95/043 108/27
7,361,075 B1 4/2008 Krull
D598,562 S * 8/2009 Chen ..... D24/211
D616,086 S * 5/2010 Barbagiovanni ..... D24/105
7,774,963 B2 * 8/2010 Puglisi ..... G09F 23/00 40/334
7,780,499 B1 * 8/2010 Truckai ..... A63H 33/088 401/195
7,900,583 B2 * 3/2011 Simon ..... A01K 15/025 119/702
D709,135 S * 7/2014 Haut ..... D21/398
9,950,556 B1 * 4/2018 Laemle ..... B43K 29/00
10,086,641 B1 * 10/2018 Vazquez ..... A63H 33/00
10,293,633 B2 * 5/2019 Hoffman ..... B43K 29/00
2002/0032069 A1 * 3/2002 Arrison ..... B43K 23/016 473/36
2002/0170133 A1 * 11/2002 McDevitt ..... A41D 13/087 15/167.1
2003/0068955 A1 * 4/2003 Vick ..... A61L 9/12 446/369
2004/0127139 A1 * 7/2004 Schwartz ..... A63H 33/006 446/227
2004/0161289 A1 * 8/2004 Silberman ..... B43K 29/00 401/195
2005/0079003 A1 * 4/2005 Buck ..... B43K 27/00 401/195
2005/0286962 A1 * 12/2005 Cheng ..... B43K 23/004 401/6
2006/0183396 A1 * 8/2006 Kanahele ..... A63H 33/006 446/26
2006/0183397 A1 * 8/2006 Kanahele ..... A63H 33/006 446/26
2006/0260098 A1 * 11/2006 Brown ..... B43K 29/00 16/421
2006/0280545 A1 * 12/2006 Zawitz ..... B43K 5/005 401/6
2007/0041780 A1 * 2/2007 Hsu ..... B43K 5/005 401/195
2007/0048067 A1 * 3/2007 Gerules ..... B43K 23/001 401/195
2007/0059089 A1 * 3/2007 Junkins ..... B43K 5/005 401/195
2007/0110494 A1 * 5/2007 Berman ..... B43K 23/008 401/6
2008/0096457 A1 * 4/2008 Urias ..... A41B 13/00 446/26
2008/0175650 A1 * 7/2008 Geddes ..... B43K 23/001 401/195
2008/0261484 A1 * 10/2008 Culpepper ..... A63H 3/16 446/373
2009/0149698 A1 6/2009 Tastard
2010/0143019 A1 * 6/2010 Merla, Jr. ..... B43K 1/08 401/7
2011/0281688 A1 11/2011 Harris, Jr. et al.
2012/0318707 A1 * 12/2012 Zivitz ..... B43K 23/008 206/575
2014/0037361 A1 * 2/2014 Kalif ..... B43K 29/00 401/195
2014/0093300 A1 * 4/2014 Schwartzberg ..... B43K 29/00 401/195
2014/0243895 A1 * 8/2014 Kellogg ..... A61J 17/02 606/235
2015/0090059 A1 * 4/2015 Lee ..... F16H 25/122 74/89
2016/0158658 A1 * 6/2016 Lakritz ..... A63H 3/02 446/71
2017/0106692 A1 * 4/2017 Imbesi ..... B43K 23/001
2019/0105578 A1 * 4/2019 Brous ..... A63H 13/20

* cited by examiner

FIDGET SLEEVE

BACKGROUND (1) Technical Field

The disclosure relates to sensory manipulative tools, and more particularly, to a sleeve for mounting sensory manipulative tools onto an elongated base structure.

(2) Description of the Related Art

It has been discovered that people having issues such as Attention Deficit Hyperactivity Disorder (ADHD) can benefit in a school setting when they have a way to release their energy while engaged in the learning process. For example, if these students can keep their hands busy, they may be able to pay better attention to lectures or other learning situations than if their hands are not kept busy.

A variety of products are available for keeping hands busy, including stress balls, rubber bracelets, Silly Putty®, or the like. For example, U.S. Pat. No. 7,361,075 (Krull) discloses a hand-held amusement device. US Patent Application 2011/0281688 (Harris, Jr. et al) describes a manipulative device that is attached to a user's fingers and also can be attached to a pencil. US Patent Application 2009/0149698 (Tastard) shows a variety of sensory tools that can be removably attached to a weighted lap pillow.

SUMMARY

A principal object of the present disclosure is to provide a sleeve that can slip over an elongated base structure, such as a standard pencil, wherein the sleeve comprises a variety of fidgets.

Another object is to provide a fidget sleeve having a variety of textures and manipulative actions thereon.

In accordance with the objects of this disclosure there is provided a sleeve having a variety of fidgets thereon wherein the sleeve can be slipped on and off an elongated base structure.

BRIEF DESCRIPTION OF THE DRAWINGS

In the accompanying drawings forming a material part of this description, there is shown.

DESCRIPTION OF THE PREFERRED EMBODIMENTS

Figure 1:
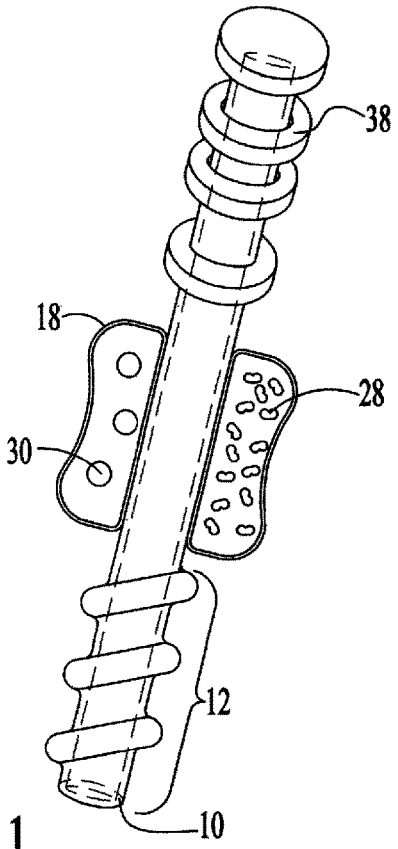
FIGS. 1-4 schematically represent several preferred embodiments of the present disclosure.

The present disclosure provides a sleeve comprising a variety of fidgets or manipulatives. The sleeve is adapted to receive an elongate writing implement such as a pencil, including a wooden pencil or a mechanical pencil, or alternately, a pen, a stylus, or a non-writing implement having a similar elongated base shape of small diameter.

Arranged on the sleeve are two or more different types of fidgets. Students can manipulate the fidgets on the sleeve, expending energy by this constant movement, thus freeing their minds to concentrate on schoolwork.

Preferably, the fidgets can provide positive sensory feedback to the students. This can be useful for students with ADHD or other issues. The material of the fidgets can be such as to provide positive tactile and sensory input and may also provide a soothing or calming effect. Preferably, the material of the fidgets will be non-toxic, latex-free, and hypoallergenic. The fidgets may be formed in a variety of sizes, shapes, and colors and may be opaque or transparent.

Any of the fidgets could be scented, for example, with a light fruity scent or peppermint or other herbal scent. Preferably, the fidgets will not make noise so as to not be distracting to other students in the classroom. The fidgets can relieve stress and promote attention to task.

Referring now to the drawing FIGS. 1-4, it is noted that these drawings are examples only and are not drawn to scale. It should be understood that any of the fidgets in any of the drawings are interchangeable and that more or fewer fidgets can be provided on any one sleeve and in any order.

For example, the sleeve can be a tube 10 that can slip over a smooth elongated base structure (not shown) and remain in place, as shown in FIGS. 1-4. The elongated base structure may be a pencil, including a wooden pencil or a mechanical pencil, or alternately, a pen, a stylus, or a non-writing implement having a similar elongated base shape of small diameter. For example, some of the fidgets could be of a rubber-like material having a variety of textures. The material could have protrusions of various lengths. Some examples of these fidgets are 12 in FIG. 1, 14 in FIG. 2, and 16 and 17 in FIG. 3.

Figure 2:
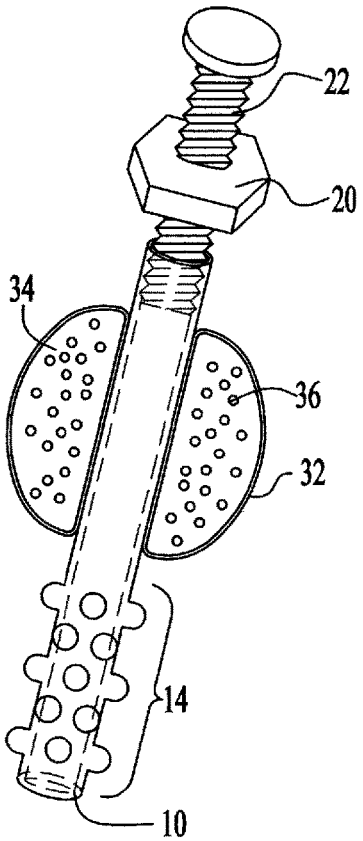

Some aspects of certain fidgets can improve hand and finger function. For example, one of the fidgets may have a weighted component that provides sensory feedback in the writing process, such as 18 in FIG. 1. In another example, one of the fidgets may be a nut 20 that is turned on a screw 22, as shown in FIG. 2. The threaded end of the screw is permanently attached inside the top end of the sleeve. The head of the screw prevents the nut from being removed from the screw. As a student turns the nut up and down on the screw with a thumb, the hand muscles are exercised in such a way as to improve writing ability. The nut and screw can be of any shape. For example, the nut could be a hex nut as shown or a wing nut or have the shape of an animal or vehicle, or any other interesting shape, including licensed characters, for example.

The fidgets must be durable enough so that they cannot be picked apart. Preferably, the fidgets can be molded into the sleeve in the manufacturing process. A variety of different types of fidgets having different textures and manipulative actions should be included on each sleeve. Also, since the sleeve can be easily slipped onto a pencil or similar base structure, one sleeve can be interchanged for another when a student tires of the first sleeve or as a reward for good work.

Some of the fidgets could be of fabric having textures such as smooth like satin or ridged like corduroy or any other pleasing texture. The fabric could be made in a tube shape to fit over the sleeve, such as 18 in FIG. 1 (shown in cross-section) or 24 in FIG. 4. The fabric tube could fit snugly against the sleeve and could be glued to the sleeve or held against the sleeve at either end by elastic, for example. Instead of fitting snugly against the sleeve, the fabric sleeve could have a foam-like material between it and the sleeve (24) or could have "beans" 28 such as in a bean bag or sand or the like between it and the sleeve. Alternately, a few beads 30 could be placed between the fabric and the sleeve. All of these examples provide different textures and manipulatives.

Another type of fidget could be a clear plastic material, such as 32 in FIG. 2 (shown in cross-section), having a gel-like substance 34 inside it so as to provide a moveable material when manipulated with the fingers. Small beads or glitter 36 could be provided within the gel-like substance. The plastic material should be strong enough to avoid breakage and the gel-like substance should be non-toxic.

A further type of fidget could be one that moves such as a ring (38 in FIG. 1) that can be spun in place and/or moved up and down on the sleeve. A gel-filled or rubber-type ring or protrusion (40 in FIG. 4) can be tapped noiselessly against a desk. A screw and nut combination (22, 20 in FIG. 2) wherein the nut can be spun up and down the screw is another example of a moveable fidget.

Figure 3:
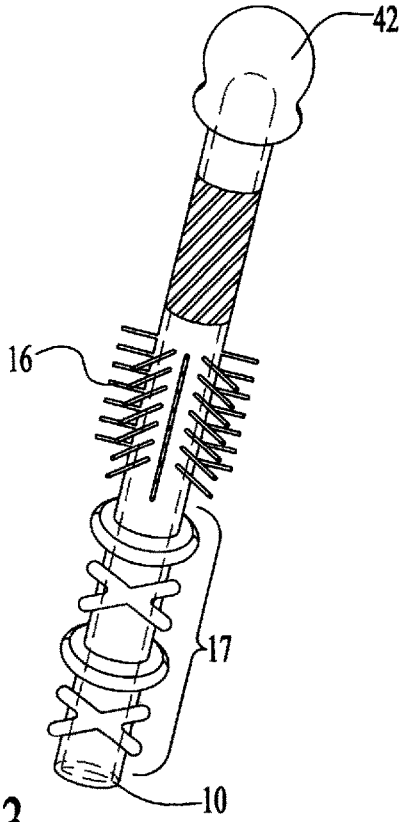
Figure 4:
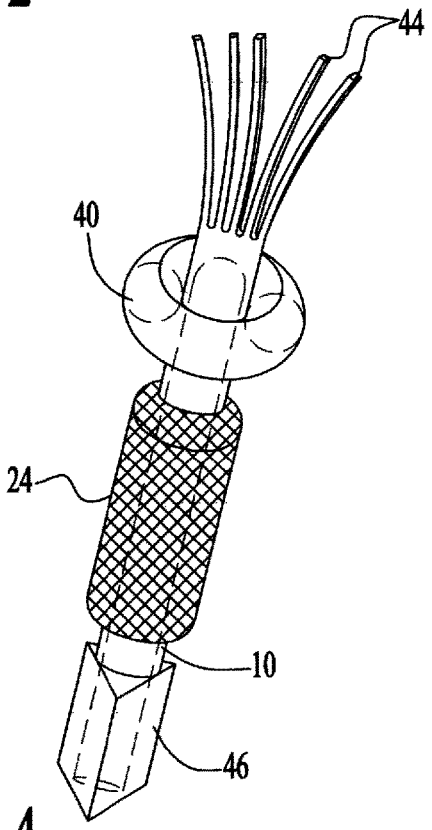

A chewable fidget could be attached to or molded onto the top of the sleeve, such as 42 in FIG. 3 or 44 in FIG. 4. The top side of the sleeve should be closed so that saliva does not drip onto the base structure. The sleeve with its fidgets should be easy to clean especially if a chewable fidget is to be used.

If the sleeve is used on a writing implement, it may be desirable to provide a pencil grip on the lower end of the sleeve. The grip, shown for example as 46 in FIG. 4, should be textured and shaped so as to facilitate holding the writing implement in a comfortable manner.

A wide variety of fidgets can be provided in any combination on several sleeves. as many as six or even more different fidgets can be provided on each sleeve. The sleeve can be removed easily for cleaning, sharpening the pencil, or changing to a different sleeve. The design includes a wide variety of textures, colors, shapes, and manipulations. The fidgets are designed so as not to make noise that would distract other students.

Although the preferred embodiment of the present disclosure has been illustrated, and that form has been described in detail, it will be readily understood by those skilled in the art that various modifications may be made therein without departing from the spirit of the disclosure and the scope of the appended claims.

What is claimed is:

1. A plurality of removable sleeves, each removable sleeve comprising:

an elongate hollow tube having two or more different types of manipulatives, each manipulative having a different manipulative action, molded onto or permanently attached to an outside surface of said tube wherein at least one of said manipulatives comprises a nut turned on a screw attached at an upper end portion of said tube wherein said nut is not removable from said sleeve wherein said sleeve is configured to be slipped over a writing implement wherein said sleeve is configured to have a lower portion thereof configured to be used by a user to hold said writing implement during a writing process, wherein said sleeve is configured to remain in place during use of said writing implement in said writing process, wherein said manipulatives are configured to be manipulated by said user allowing expenditure of energy by manipulation of said manipulatives, and wherein said sleeve is configured to be slipped off of said writing implement and replaced by another one of said plurality of sleeves.

2. The removable sleeves according to claim 1 wherein said tube is closed at one end.

3. The removable sleeves according to claim 2 wherein at least one of said manipulatives is located on said outside surface of said tube at said closed end.

4. The removable sleeves according to claim 3 wherein said at least one of said manipulatives is capable of being chewed.

5. The removable sleeves according to claim 1 wherein said two or more manipulatives differ in one or more of textures, colors, shapes, and manipulations.

6. The removable sleeves according to claim 1 wherein at least one of said manipulatives comprises a rubber material having protrusions.

7. The removable sleeves according to claim 1 wherein at least one of said manipulatives has a weighted component that provides sensory feedback in said writing process.

8. The removable sleeves according to claim 1 wherein said nut has a shape comprising a hex nut, a wing nut, an animal, a vehicle, an interesting shape, or a licensed character.

9. The removable sleeves according to claim 1 wherein at least one of said manipulatives comprises a fabric having a texture.

10. The removable sleeves according to claim 9 wherein a material is placed between said fabric and said sleeve and wherein said material is chosen from a group containing beans, beads, sand, gel, and foam.

11. The removable sleeves according to claim 1 wherein at least one of said manipulatives comprises a clear plastic containing a gel.

12. The removable sleeves according to claim 11 wherein said gel contains glitter, beads, or other objects that can be manipulated.

13. The removable sleeves according to claim 1 wherein at least one of said manipulatives is movable.

14. The removable sleeves according to claim 13 wherein said moveable manipulative comprises a ring that can be moved up and down and rotated on said sleeve or said nut that can be screwed up and down on said screw wherein said ring or said nut are not removable from said sleeve.

15. The removable sleeves according to claim 1 wherein at least one of said manipulatives comprises a rubber or foam material that can be tapped noiselessly on a surface.

16. The removable sleeves according to claim 1 further comprising a pencil grip on a lower end of said sleeve.

17. The removable sleeves according to claim 1 wherein any of said two or more manipulatives are scented.

18. The removable sleeves according to claim 1 wherein all of said manipulatives are non-toxic and hypoallergenic.

19. The removable sleeves according to claim 1 wherein all of said manipulatives are latex-free.

20. A plurality of removable sleeves, each removable sleeve comprising:

an elongate hollow tube having six or more different types of manipulatives, each manipulative having a different manipulative action, molded onto or permanently attached to an outside surface of said tube wherein at least one of said manipulatives comprises a nut turned on a screw attached at an upper end portion of said tube wherein said nut is not removable from said sleeve wherein said sleeve is configured to be slipped over an elongated smooth base structure wherein said elongated smooth base structure comprises a standard writing implement including a wooden pencil, a mechanical pencil, a pen, or a stylus, or a non-writing implement having a similar shape and diameter as a standard writing implement, wherein said sleeve is configured to have a lower portion thereof configured to be used by a user to hold said writing implement or said non-writing implement during a writing process, wherein said manipulatives are configured to be manipulated by said user allowing expenditure of energy by manipulation of said manipulatives, and wherein said sleeve is configured to be slipped off of said elongated smooth base structure and replaced by another one of said plurality of sleeves.

* * * * *